United States Patent [19]

Braedle et al.

[11] Patent Number: 4,986,806

[45] Date of Patent: Jan. 22, 1991

[54] GUSSET TUBING FORMER

[75] Inventors: Gilbert Braedle, Ringendorf; Paul Cromer, Stotzheim; Francis Huck, Rosenwiller, all of France

[73] Assignee: H.I. Holweg International, Rosheim, France

[21] Appl. No.: 375,350

[22] Filed: Jul. 3, 1989

[30] Foreign Application Priority Data

Jul. 5, 1988 [FR] France ..... 88 09270

[51] Int. Cl.[5] ..... B31B 1/40; B65H 45/08

[52] U.S. Cl. ..... 493/468; 493/248; 493/295; 493/302; 493/439

[58] Field of Search ..... 493/248, 295, 302, 439, 493/446, 455, 468, 940

[56] References Cited

U.S. PATENT DOCUMENTS

| | | | |
|---|---|---|---|
| 407,813 | 7/1889 | Burdick | 493/936 |
| 2,631,332 | 3/1953 | Reber | 493/450 |
| 3,111,310 | 11/1963 | Dutro et al. | 493/439 |
| 3,408,903 | 11/1968 | Lepisto et al. | 493/248 |
| 3,976,418 | 8/1976 | Leathers | 493/440 |
| 4,321,051 | 3/1982 | Hajek et al. | 493/439 |
| 4,578,051 | 3/1986 | Everman | 493/439 |
| 4,591,354 | 5/1986 | Gelbard | 493/446 |
| 4,648,861 | 3/1987 | Pierce | 493/418 |

FOREIGN PATENT DOCUMENTS

| | | | |
|---|---|---|---|
| 230722 | 12/1963 | Austria | 493/439 |
| 827581 | 7/1949 | Fed. Rep. of Germany | 493/248 |

*Primary Examiner*—William E. Terrell

*Attorney, Agent, or Firm*—Sandler, Greenblum & Bernstein

[57] ABSTRACT

A gusseted tubing former designed to be incorporated in a bag manufacturing line, preferably for manufacturing paper bags from a continuous paper web. The web is formed around the periphery of the former to produce a continuous tubing. As the tubing moves along the former in the manufacturing line, it emerges in the form of a flat tubing which includes two inwardly directed gussets, or folds. To prevent transverse stresses on the web during the formation of the gussets, the former includes edges which longitudinally extend in a direction which follows the folding lines of the gussets of the tubing as the tubing is progressively flattened from an upstream end to a downstream end of the former.

9 Claims, 2 Drawing Sheets

Fig. 2
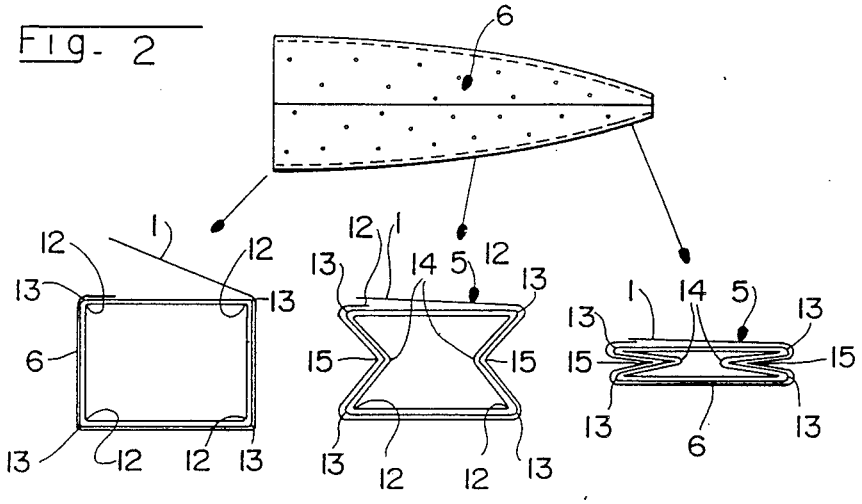
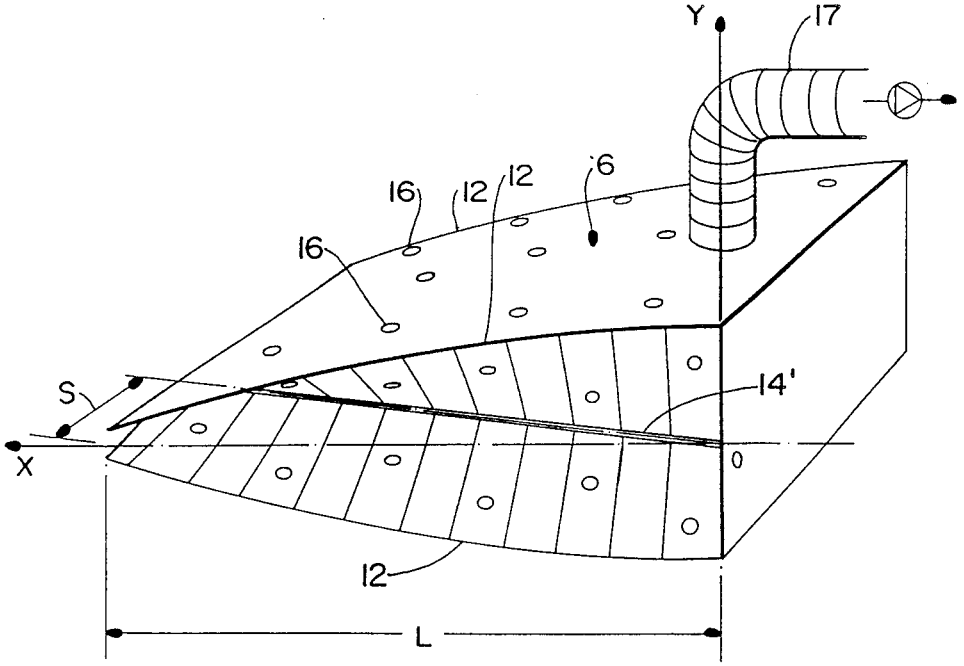
Fig. 3

GUSSET TUBING FORMER

BACKGROUND OF THE INVENTION

1. Field of the Invention

The present invention relates to a gusseted tubing former designed to be incorporated in a manufacturing line, in particular for the manufacture of paper bags intended for the packaging industry. The former of the invention is also capable of being used in connection with other materials as well.

2. Description of Background and Other Information

A gusseted bag manufacturing line uses as raw material a continuous paper web in the form of a roll. During the processing of the web along the manufacturing line, various operations are performed, such as forming a tubing therealong, prior to the formation of individual paper bags. Along the manufacturing line, prior to the formation of the tubing at the former, the web is coated with glue on one of its sides. Thereafter, as the flat web is continuously moved along the manufacturing line, it is transformed into a continuous tube at the former as the two sides of the web rolled together and are attached by means of the glue.

The manufacturing process becomes more complicated when, in addition to the formation of a continuous web, lateral gussets, or folds, are to be formed. For this purpose, it is known to use a machine that manufactures paper bags from a continuous web, wherein the gussets are formed by means of a vacuum former around which the tubing is formed. The profile of the tubing is modified progressively by means of outside knurls that ensure the formation of the folds required for the formation of the gussets.

The profile of the former in the aforementioned machine is approximately triangular at the inlet, i.e., at the upstream end of the former, and it progressively flattens at the outlet, i.e., at the downstream end of the former, in a rectangular form.

The use of a vacuum former constitutes a major advance compared to prior techniques, particularly considering that it permits a continuous forming operation, which is a critical point in the manufacturing line. The manufacturing rate can be restricted by the ability of the former, including the aforementioned knurls, to allow for the folding of the tubing without tearing the tubing.

In current installations, the edges of the former are strictly linear and, therefore, fail to correspond, in any event, to the path followed by the paper web. Consequently, during the formation of the bags, the paper web is made to slide transversely over the former, particularly at the edges of the former. These are precisely the locations at which the frictional forces affecting the web are the greatest. Further, these forces frequently cause the web to tear when production rates are high.

These devices are extremely expensive for manufacturers since, in addition to the replacement of the paper web which is wasted upon tearing, it is necessary to restart the entire line, which necessitates the restarting of each work station, which consumes a very long period of time.

SUMMARY OF THE INVENTION

It is an object of the present invention to provide a former adjusted to high manufacturing rates. For this purpose, the profile, or shape, of the former is designed to minimize the stresses created in the paper web during manufacturing, which minimizes the hazards of tearing the web.

To this end, the present invention concerns a gusseted tubing former designed to be incorporated in a manufacturing line for bags, paper bags in particular, from a continuous flat web which is formed into a continuous tubing by being curved around the periphery of the former, at the inlet, or upstream end, of the former. The continuous tubing is moved rectilinearly along the former and emerges at the outlet, or downstream end, of the former, as a flat tubing having two inwardly directed gussets, or folds. The former of the invention includes generally longitudinally extending edges having a shape, or profile, which follows the folding lines of the gussets of the tubing as the tubing progresses along the former. That is, the paper web is trained along the particular profile of the former during the course of continuous movement of the web along the former.

Unlike the conventional formers on which the paper web is subjected to a longitudinal tensile stress that corresponds to the progress of the web and to a transverse stress that is needed for the purpose of forming the folds of the gussets, the former according to the invention does not cause any transverse stress and the tensile stress alone is maintained.

Another object of the invention is to provide a gusseted tubing former that does not require any auxiliary equipment.

Furthermore, with the former of according to this invetion, the profile of the gusseted tubing is foolproof. Under such conditions, the machine can be adjusted quickly without specialized staff.

BRIEF DESCRIPTION OF THE DRAWINGS

The invention is described below in greater detail with reference to the drawings which illustrate only a single embodiment of the invention, in which:

FIG. 2 illustrates the details of the formation of the gussets in the tubing at three distinct points along the former; and FIG. 3 is a perspective view of the former according to the invention.

DETAILED DESCRIPTION OF THE PREFERRED EMBODIMENT

Figure 1:
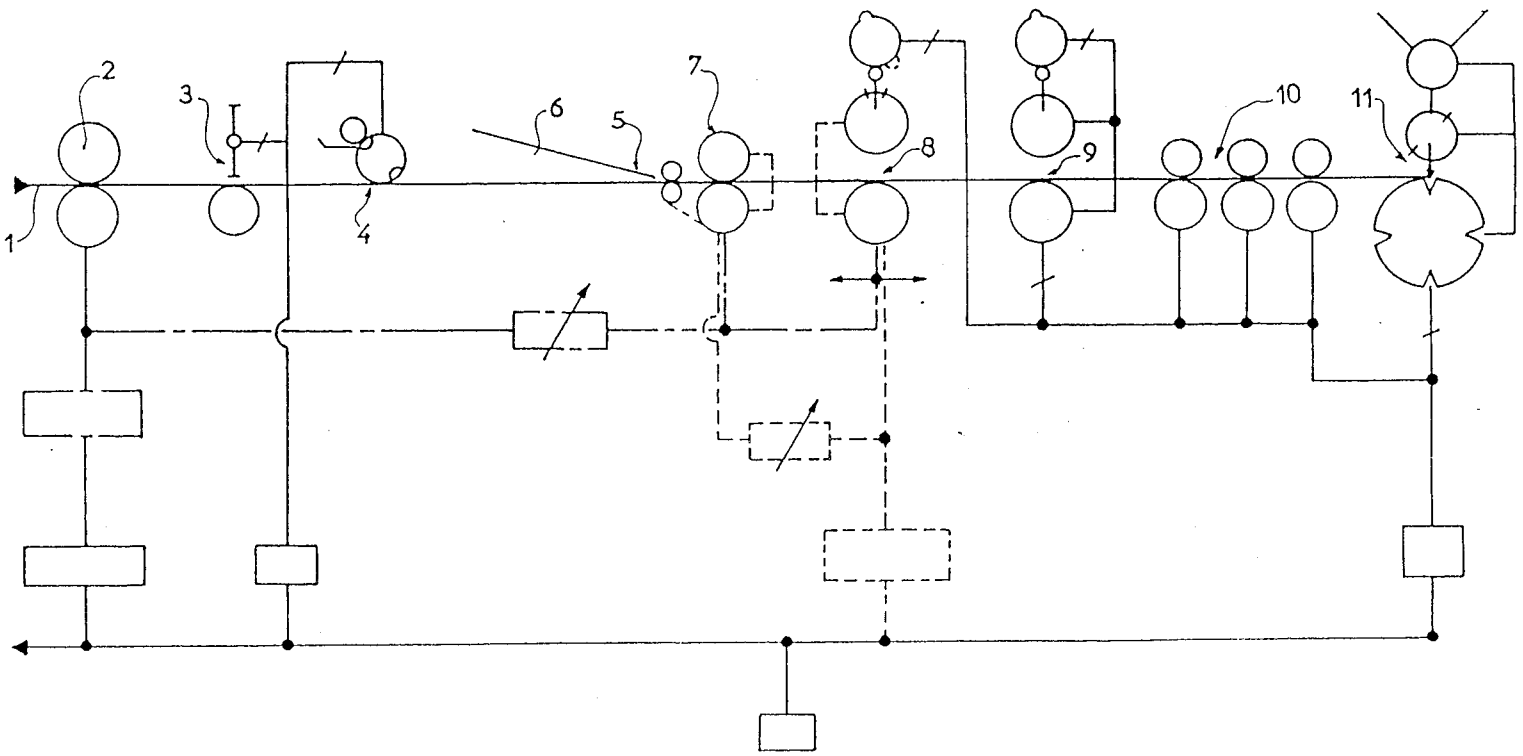
FIG. 1 is a schematic illustration of a paper bag manufacturing line, including the former.

The invention relates to a gusseted tubing former designed to be incorporated in a manufacturing line for bags, paper bags in particular, from a continuous web which is formed into a continuous tubing by being curved around the periphery of the former, at the inlet, or upstream end, of the former. The continuous tubing is moved rectilinearly along the former and emerges at the outlet, or downstream end, of the former, as a flat tubing having two inwardly directed gussets, or folds.

As will be described below, the former has perforations extending through its outer surface which communicate with a cavity within the former which is placed in communication with a vacuum source. Vacuum is utilized in connection with formers in existing manufacturing lines in which tubing is formed from a continuously driven paper web. However, for the purpose of forming the necessary folds for the gussets in the tubing, outside knurls are used.

According to current techniques, the paper tubing is released progressively from the former, which allows for exerting a folding action on the free areas. However, this method causes heavy stresses in the paper web, which tends to tear. The edges of such known formers are generally rectilinear. However, the path defined by the former edges does not correspond to the path taken by the paper web. Consequently, the paper web is made to slide transversely along the edges of the former, resulting in the creation of transverse stress that is added to the longitudinal stress from the circulation of the paper web.

In order to prevent the tearing of the continuous paper web, the manufacturing rate of known apparatus is required to be reduced.

FIG. 1 shows a diagrammatic view of a kinematic manufacturing line for paper bags made from a continuously driven paper web 1, which is conveniently packed in rolls. Drawing rollers 2 are used to feed the kinematic line. A perforator 3 makes transverse perforations in the paper web 1 at regular intervals and marks off the length of the bags.

A gluing station 4 coats one of the edges of the paper web 1 with glue for the purpose of forming a tubing 5. The tubing 5 is formed by bringing the paper web 1 around the former 6, which is ensured by means of a frictional drive system 7 of adjustable speed. As the paper web 1 is brought around the former, the two edges are affixed together by means of the glue applied to an edge of the web, as mentioned above. The progressive advance of the tubing 5 around the former 6 is ensured by means of a friction drive system 7 having an adjustable speed.

Downstream of the friction drive system 7, the tubing 5 is cut into sections by means of the drive systems 8 and 9 which are driven at different speeds and rhythms. The tubing sections are then conveyed by means of conveyor rollers 10 to a station 11 for folding and for gluing the bottom of the bags.

The tubing forming station constitutes a key function of the system as it restricts the manufacturing rate and as it is very sensitive where the quality of the paper used is concerned.

According to the main characteristic feature of the invention, the profile of the lateral sides and the edges of the former follows the folding line of the gussets of the tubing 5 during the progress of the tubing along the former 6.

FIG. 2 schematically illustrates the implementation of the former of the present invention and includes a side elevation view of the former, including cross-sectional representations at the inlet, outlet, and an intermediate portion of the former, together with the paper web extending about the former.

FIG. 3 illustrates the former 6 in perspective, illustrating the single, or unitary, body from which the former of the invention is comprised and around which the paper web is trained.

At the inlet, or upstream end, of the former 6, the paper web 1 is caused to be trained against the periphery of the former 6 in order to form the tubing 5. At the inlet of the former 6, the former has a rectangular transverse profile, whose width corresponds to that of the bag to be formed. In this manner, the corners 12 of the former correspond to the folding lines of the gussets to be formed.

The former 6 has a constant width along its length. Consequently, in the central portion of the former, the edges 12, which form the corners of the former, always follow the folding lines 13 of the tubing 5, as illustrated in the central portion of FIG. 2. The lateral sides 14 of the former 6 progressively hug, or train, the form of the gussets 15 of the tubing 5.

At the inlet of the former, in the rightmost portion of FIG. 3, the former has a maximum height, which determines the depth of the lateral gussets.

The former 6 is connected to a source of vacuum through a connection 17 to create a vacuum within the interior of the former. Perforations 16 extend through the peripheral surface of the former 6. Due to the vacuum existing within the former 6 communicating with the perforations 16, including those at the lateral sides of the former, the gussets 15 are formed by the lateral sides of the paper tubing 5 being pulled and progressively folded back. Tests have shown that the optimum size of the perforations 16 are about three millimeters in diameter.

At the outlet, or downstream end, of the former 6, the former is very slender and its lateral sides 14 have the shape of a sharp "V". Further, from the inlet, or upstream end, of the former 6 to the outlet, or downstream end, each of the lateral sides of the former take the shape of a "V" having a progressively increasingly acute internal angle.

During the movement of the continuous tubing 5 along the manufacturing line under the condition of vacuum at the former 6, the gussets 15 are entirely formed and the folding lines 13 are clearly marked.

The cross-sectional shape of the gusseted tubing is determined entirely by the profile of the former 6. There is no need to be concerned about any disadjustment of the apparatus. During its entire course along the former 6, the tubing 5 has its folding lines 13 correspond to the edges !2 of the former 6. This prevents any transverse shifting movement of the paper web against the edges 12 of the former 6. The paper web is subjected only to the longitudinal tensile stresses during movement of the web and tubing along the manufacturing line.

As shown in FIG. 3, each of the lateral sides of the former extend inwardly from respective upper and lower longitudinally extending edges 12 to a longitudinally extending vertex 14'. The lateral gussets 15 of the tubing 5 are formed to have a depth defined by the lateral distance between the edges 12 to the vertex, identified as S in FIG. 3.

To ensure the proper guiding of the paper tubing 5 along the former 6, the transverse periphery, or perimeter, of the former 6 should preferably be constant along the entire length of the former. In this manner, the correspondence between the perimeter of the former and the perimeter of the tubing, where the lateral gussets are being formed, will be ensured. This permits the paper tubing to be continuously applied against the lateral walls of the former 6.

As described above, the gussets 15 are progressively formed along the former 6. To this end, the edges 12 of the former 6 can be defined by the following equation with regard to the orthonormal reference points x, y, illustrated in FIG. 3:

$$Y = S\sqrt{1 - \frac{X^2}{L^2}}$$

wherein

L = the length of the body and

S = the depth of the gussets.

The material from which the former 6 is made should have a coefficient of friction that is sufficiently low so as to increase the ease of sliding the paper web 1 thereover.

We claim:

1. A gusseted tubing former for use in a manufacturing line for forming bags from a continuous web, as said web moves along said manufacturing line, for forming said continuous web, into a flattened gusseted tubular shape, said former comprising:

a unitary body around which said web is formed into a tubing as said web is moved along said manufacturing line, said unitary body having (a) a predetermined length and being adapted to extend lengthwise along said manufacturing line, (b) a predetermined width transverse to said manufacturing line, and (c) an outer surface having a transverse profile comprising a generally continuous transverse periphery along said length of said body, said transverse profile being variable along said length of said body about which said continuous web is to be trained, for facilitating formation of lateral gussets in said continuous web said continuous transverse periphery being of generally constant peripheral length along the length of said body and defining a generally open ungusseted tubular shape at an upstream end thereof and a shape at a downstream end thereof corresponding to a transverse section of said flattened gusseted tubular web, said body further comprising means for supplying vacuum to said outer surface to maintain said web against said body.

2. The gusseted tubing former according to claim 1, wherein said body has a pair of opposite lateral sides, each of said sides thereby defining a portion of said transverse profile which varies progressively along said length of said body and which said web hugs along said length of said body, for forming said lateral gussets.

3. The gusseted tubing former according to claim 2, wherein said portion of said transverse profile defined by each of said lateral sides is generally vertically rectilinear at said upstream end of said body, is generally inwardly V-shaped at said downstream end of said body, said portion of said transverse profile being generally inwardly V-shaped between said upstream end and said downstream end, said V-shaped portion being progressively, increasingly acute from said upstream end to said downstream end.

4. The gusseted tubing former according to claim 1, wherein said body has a pair of opposite lateral sides, each of said lateral sides extending inwardly from respective upper and lower longitudinally extending edges to a longitudinally extending vertex, said lateral gussets having a depth defined by the lateral distance between said edges to said vertex, wherein said longitudinally extending edges are defined, with respect to orthonormal reference points x, y, by the following equation:

$$Y = S\sqrt{1 - \frac{X^2}{L^2}}$$

wherein

L=said predetermined length of said body; and

S=said depth of said gussets.

5. The gusseted tubing former according to claim 2, wherein each of said lateral gussets has a predetermined inwardly directed depth, and wherein said body has a maximum height at said upstream end which determines said depth of said lateral gussets.

6. The gusseted tubing former according to claim 1, wherein said vacuum supplying means comprises perforations in said outer surface.

7. The gusseted tubing former according to claim 6, wherein said vacuum supplying means further comprises an internal cavity with which said perforations communicate, wherein said body comprises a connecting orifice extending through said outer surface communicating with said internal cavity and adapted to communicate with a source of vacuum.

8. The gusseted tubing former according to claim 7, wherein said perforations are approximately three millimeters in diameter.

9. The gusseted tubing former according to claim 1, wherein said outer surface has a low coefficient of friction.

* * * * *